US005895995A

United States Patent [19]

Soh

[11] Patent Number: 5,895,995

[45] Date of Patent: Apr. 20, 1999

[54] STARTER HAVING AN IMPROVED BRUSH HOLDER

[75] Inventor: Masahiro Soh, Anjo, Japan

[73] Assignee: Denso Corporation, Kariya, Japan

[21] Appl. No.: 08/976,480

[22] Filed: Nov. 24, 1997

[30] Foreign Application Priority Data

Nov. 25, 1996 [JP] Japan ..... 8-313599
Sep. 26, 1997 [JP] Japan ..... 9-261246

[51] Int. Cl.[6] ..... H01R 39/38
[52] U.S. Cl. ..... 310/239
[58] Field of Search ..... 310/239

[56] References Cited

U.S. PATENT DOCUMENTS 5,070,270 12/1991 Morikane ..... 310/239
5,608,280 3/1997 Tamemoto et al. ..... 310/239
5,610,466 3/1997 Shiga et al. ..... 310/239

FOREIGN PATENT DOCUMENTS 63-138860 9/1988 Japan .
5-332229 12/1993 Japan .
8-205483 8/1996 Japan .

*Primary Examiner*—Thomas M. Dougherty
*Assistant Examiner*—Dang Dinh Le
*Attorney, Agent, or Firm*—Pillsbury Madison & Sutro LLP

[57] ABSTRACT

A brush holder holding a brush has a brush-accommodating hole accommodating the brush. A heat release groove is formed on one surface of peripheral surfaces forming the brush-accommodating hole. The heat release groove is formed at the side of the peripheral surface, of the brush holder, confronting a side surface of the brush at which a pig tail is fixed such that the heat release groove extends in a thickness direction of the brush holder which partitions a first space located at a side in which an armature is accommodated from a second space located at an opposite side in which an electromagnetic switch is accommodated. The heat release groove communicates the first and second spaces with each other. A wall surface of the heat release groove confronting the side surface of the brush is inclined such that the distance between the side surface and the wall surface becomes gradually greater rearward from the commutator surface in a thickness direction of the brush holder.

16 Claims, 4 Drawing Sheets

STARTER HAVING AN IMPROVED BRUSH HOLDER

BACKGROUND OF THE INVENTION

1. Field of the Invention

The present invention relates to a starter for starting an engine and, more particularly, to a starter having an improved brush holder.

2. Description of Related Art

In recent years, the engine compartment of a vehicle has become dense with auxiliary devices to allow the engine to have high performance and high function. In such a situation, there is a demand for the development of a compact starter to load the vehicle with a lot of auxiliary devices.

To comply with such a demand, it is proposed in Laid-Open Japanese Patent Publication No. 5-332229 that the slidable contact surface of a disk or surface commutator of an armature is disposed substantially perpendicularly to the rotation shaft of the armature. This construction allows the starter to be compact because the entire axial length of the armature is shorter than the conventional one having a cylindrical commutator. Further, in the starter, an electromagnetic switch for controlling the supply of electric current to the armature is positioned axially rearward from the armature. This construction allows the starter to have more auxiliary devices than the biaxial type conventional one in which the electromagnetic switch is positioned radially outward from the starting motor.

However, in the above starter, the movement of the armature is allowed to some extent in the axial direction of its rotation shaft so that the thrust of the armature does not become zero. Because, if the thrust becomes zero, mechanical loss increases and output decreases. In this construction, the armature moves axially due to fluctuation of a load applied to the armature in its rotation when the engine is driven. In addition, the vibration of the engine is amplified, because the electromagnetic switch is positioned rearward from the armature in its axial direction. Consequently, the brush is incapable of stably contacting the surface of the commutator, which deteriorates the commutation and reduces the longevity of the brush. In consideration of the abrasion of the brush, it is necessary to provide the starting motor with a long brush.

Because the electromagnetic switch is positioned rearward from the armature in its axial direction, the brush is proximate to the electromagnetic switch. Therefore, subjected to the heat generated by the electromagnetic switch, the temperature of the brush rises. Consequently, the longevity of the brush is reduced owing to the increase in the resistance generated between the contact of the surface of the commutator and the surface of the brush caused by a temperature rise in both contact surfaces. In addition, the brush holder made of resin for holding the brush has a low degree of thermal conductivity and surrounds the brush to firmly hold the brush therein. Thus, it is difficult to release the heat generated by the brush. This is also the reason which shortens the longevity or life of the brush.

Further, in the above starter, the slidable contact surface of the commutator of the armature is substantially perpendicular to the rotation shaft of the armature, and the electromagnetic switch is positioned at the side opposite to the armature side with respect to the brush holder holding a plurality of brushes which contact the commutator. In keeping the insulation performance of the electric-conductive portion of an electromagnetic switch, the holder is required to be provided with a partitioning wall to prevent the powder of the brush generated by the slidable contact of the surface thereof with the surface of the commutator from penetrating into the space in which the electromagnetic switch is positioned.

SUMMARY OF THE INVENTION

It is accordingly an object of the present invention to provide a starter which, without shortening durability of a brush, ensures insulation performance of an electric-conductive portion of an electromagnetic switch positioned axially rearward from an armature.

It is another object of the present invention to provide a starter which can efficiently release heat generated by a brush by using a wear-allowable portion of the brush effectively.

According to the present invention, a concave, i.e., a concavity, is formed on a peripheral surface on which a brush-accommodating hole is formed and open toward a space accommodating an electromagnetic switch, thus communicating therewith. Through the concave, heat generated by the brush can be released to the space accommodating the electromagnetic switch. This construction prevents the temperature rise of the brush and prolongs its longevity. Further, a partitioning portion of the brush holder partitions a space accommodating a commutator and the space accommodating the electromagnetic switch from each other, thus preventing powders of the brush generated by the slidable contact between the brush and the commutator surface from penetrating into the space accommodating the electromagnetic switch. Thus, the powders can be prevented from attaching to and accumulating on the electric-conductive portion of the electromagnetic switch and insulating parts in the periphery thereof, which prevents the insulation performance of the electric-conductive portion from deteriorating.

Preferably, the concave is formed on the peripheral surface, of the brush holder, on which the brush-accommodating hole is formed such that the heat release concave is located at a slidable-contact termination side of the brush in a rotational direction of the commutator. Therefore, the heat of the brush can be released through the concave to the space accommodating the electromagnetic switch. This construction prevents powders of the brush generated by the slidable-contact between the brush and the commutator surface from striking the slidable-contact starting side of the brush and penetrating into the space accommodating the electromagnetic switch while the commutator is rotating.

Preferably, the concave is formed at a side of the peripheral surface confronting a pig tail-fixed side surface of the brush and functions as a groove into which the pig tail enters when the entire length of the brush becomes short due to its wear. The concave prevents the pig tail from interfering with the brush holder when the brush becomes short and accommodates the pig tail. Therefore, the concave allows the brush which has become short to be effectively used and the durability of the brush to be equal to that of the conventional one.

Preferably, supposing that a width of the brush side surface confronting the concave-formed peripheral surface is W1 and a width of the concave is W2, the relationship of $W2<W1$ is satisfied. This construction prevents the brush from dropping to the concave from the brush-accommodating hole, thus reliably holding the brush.

Preferably, the pig tail connected with at least one of the brushes is electrically and mechanically connected with a movable contact of the electromagnetic switch. When the pig tail of the brush is connected with the movable contact, the plunger of the electromagnetic switch is moved by the vibration of the engine. As a result, the brush is vibrated greatly in slidable contact with the commutator surface and in addition, heat generated at the portion of contact between the movable contact and fixed contact is transmitted to the brush through the pig tail. Consequently, the longevity of the brush is greatly reduced. The heat release groove releases the heat of the brush, thus prolonging the longevity of the brush.

Preferably, the brush holder is formed of resin or ceramic which has a low degree of thermal conductivity than a material, for example, iron or ceramic having a high degree of thermal conductivity, so that the heat of the brush can be efficiently released from the concave and hence the brush has a long longevity.

BRIEF DESCRIPTION OF THE DRAWINGS

Other objects, features and advantages of the present invention will become more apparent from the following detailed description when read with reference to the accompanying drawings, in which.

DETAILED DESCRIPTION OF THE PREFERRED EMBODIMENTS (First Embodiment)

Figure 1:
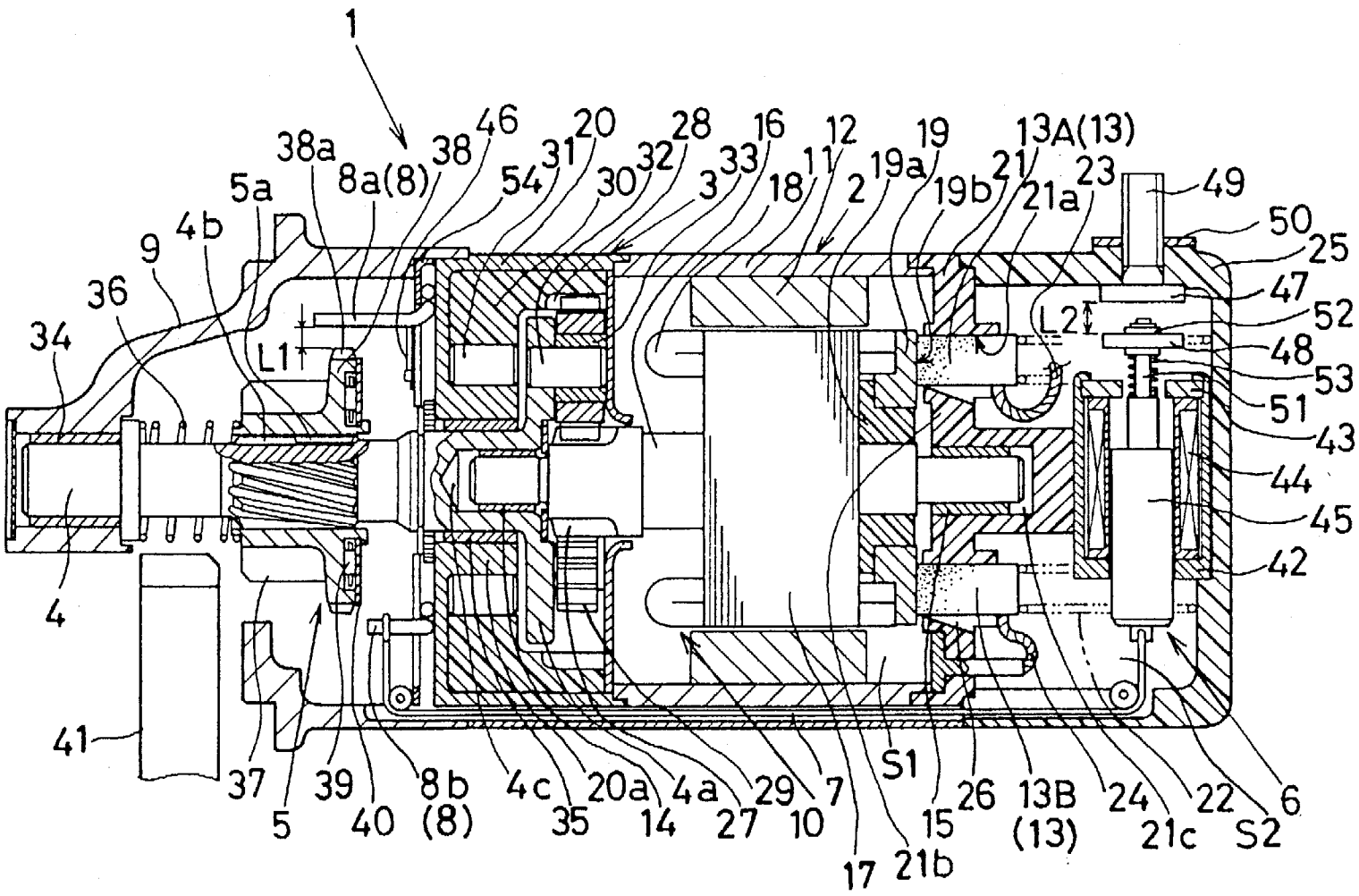
FIG. 1 is a sectional view showing a starter according to a first embodiment of the present invention.

A starter according to the first embodiment comprises, as shown in FIG. 1, comprises a starting motor 2 generating a rotational force; a reduction gear 3 for reducing the rotational speed of the starting motor 2; an output shaft 4 rotating upon receipt of the rotational force of the starting motor 2 reduced by the reduction gear 3; a pinion-moving member 5, a helical spline of which mates with a helical spline formed on the output shaft 4; an electromagnetic switch 6 controlling the supply of electric current to the starting motor 2; a rotation restriction member 8 restricting the rotation of the pinion-moving member 5 upon receipt of the attraction force of the electromagnetic switch 6 transmitted through a cord-shaped member 7; and a housing 9 fixedly mounted on an engine in an engine compartment.

The starting motor 2 comprises an armature 10; a yoke 11; a fixed magnetic pole 12; and a brush 13. The armature 10 comprises a rotation shaft 16, both ends of which are rotatably supported through bearings 14 and 15, respectively; an armature core 17 fitted on the periphery of the rotation shaft 16 and rotating together therewith; an armature coil 18 provided on the armature core 17; and a commutator 19 connected with the armature coil 18 electrically and mechanically. The commutator 19 positioned at the rear axial end of the armature core 17 and fixed to the periphery of the rotation shaft 16 through insulating resin 19*a* such that a commutator surface 19*b* (surface which slidably contacts the brush 13) is approximately perpendicular to the rotation shaft 16.

The yoke 11 is cylindrical and forms a magnetic frame. One end of the yoke 11 fits in an open end of a center case 20 covering the reduction gear 3 by a spigot joint and the other end thereof fits in an end of the periphery of a brush holder 21 holding the brush 13 by a spigot joint.

The fixed magnetic pole 12 comprises a plurality of permanent magnets and is fixed to the inner peripheral surface of the yoke 11, with the fixed magnetic pole 12 spaced at a slight interval from the peripheral surface of the armature 10.

The brush 13 comprises a positive polarity brush 13A and a negative polarity brush 13B, each of which is accommodated in a brush-accommodating hole 21*a* formed on the brush holder 21. Both brushes 13A and 13B are movable in the axial direction of the armature 10 and pressed against the commutator surface 19*b* by a spring 22 connected with the rear end thereof. One end of each of pig tails 23 and 24 is fixed to a rear side surface 13*a* of the positive polarity brush 13A and that of the negative polarity brush 13B, respectively so that the positive polarity brush 13A is connected with a terminal (not shown) of the electromagnetic switch 6 through the pig tail 23 and the negative polarity brush 13B is grounded through the pig tail 24.

The brush holder 21 made of resin is held between the yoke 11 and a rear case 25 and has a partitioning portion 21*b* partitioning a space S1 accommodating the armature 10 and a space S2 accommodating the electromagnetic switch 6 from each other. The brush-accommodating hole 21*a* is formed on the partitioning portion 21*b*. A cylindrical bearing-accommodating portion 21*c* is formed at the radial center of the brush holder 21. The bearing 15 supporting the other end of the rotation shaft 16 is held in the bearing-accommodating portion 21*c*.

A plurality of the brush-accommodating holes 21*a* is formed radially outwardly from the bearing-accommodating portion 21*c* and shaped in conformity with the sectional shape (rectangule) of the brush 13. A heat release groove (concave) 26 for releasing the heat of the brush 13 is formed on a surface of the partitioning portion 21*b* on which the brush-accommodating hole 21*a* is formed.

The reduction gear 3 comprises a sun gear 27 formed at one end of the periphery of the rotation shaft 16; an internal gear 28 positioned radially outwardly from the sun gear 27; and a plurality of planetary gears 29 positioned between the sun gear 27 and the internal gear 28 and engaging the sun gear 27 and the internal gear 28.

The internal gear 28 is positioned at the rear end of the inner periphery of an outer member 30 positioned on the inner periphery of the center case 20. A one-way clutch is constituted by rollers 31 and a bearing-holding portion 20*a* extending from the center case 20 into the inner periphery of the rollers 31. Due to the function of the one-way clutch, the outer member 30 is nonrotatable in the forward rotatable direction of the armature 10 with respect to the center case 20 and rotatable in the reverse rotatable direction of the armature 10. The center case 20 is nonrotatably interposed between the housing 9 and the yoke 11.

The planetary gear 29 is rotatably supported through a bearing 33 engaging a pin 32 pressed into a flange-shaped large-diameter portion 4*a* formed on the periphery of the output shaft 4 at the rear end thereof.

One end of the output shaft 4 coaxial with the rotation shaft 16 is rotatably supported through a bearing 34 held by the housing 9, and the other end thereof is rotatably supported through a bearing 35 held by a bearing-holding portion 20*a* of the center case 20. Thus, the output shaft 4 is prevented from moving axially. A helical spline 4*b* is formed at a portion of the peripheral surface of the output shaft 4 projecting forward (left-hand side in FIG. 1) from the center case 20. The bearing 14 supporting one end of the rotation shaft 16 is fixed to a concave 4*c* formed at the rear end of the output shaft 4.

The pinion-moving member 5 has a helical spline 5*a* on its inner periphery. The helical spline 5*a* fits in the helical spline 4*b* of the output shaft 4, thus allowing the pinion-moving member 5 to move along the output shaft 4. A spring 35 positioned forward from the pinion-moving member 5 urges the pinion-moving member 5 rearward constantly. The pinion-moving member 5 comprises a pinion gear 37 and a collar 38 integral therewith. A washer 40 rotatably supported through a roller 39 is positioned at the rear end surface of the collar 38. The pinion gear 37 is engageable with a ring gear 41 formed on the driving shaft of the engine when the pinion-moving member 5 has moved forward (left-hand side) a predetermined amount along the output shaft 4. The collar 38 positioned at the rear end of the pinion gear 37 has a greater outer diameter than the pinion gear 37 and has a large number of teeth 38*a* formed on its peripheral surface.

The electromagnetic switch 6 is positioned axially rearward from the brush holder 21 and covered with a resinous cup-shaped rear case 25 formed by molding. The electromagnetic switch 6 comprises a frame 42 formed approximately cylindrically by molding; a ground plate 43 fixed to an open upper end of the frame 42 by caulking; an attraction coil 44 accommodated in the frame 42; a plunger 45 slidable through the inner periphery of the attraction coil 44 through a hole which is open at the lower end of the frame 42. A motor contact (described later) mounted on the electric circuit of the starting motor 2 is turned on and off according to the movement of the plunger 45.

The frame 42, the ground plate 43, and the plunger 45 are formed of a magnetic material, respectively, thus constituting the magnetic circuit of the electromagnetic switch 6.

The plunger 45 confronts the ground plate 43 through an air gap inside the attraction coil 44. When the attraction coil 44 is energized and a magnetic flux flows through the magnetic circuit, the plunger 45 is attracted toward the ground plate 43 upon receipt of a magnetic force acting between the ground plate 43 and the plunger 45. When the supply of electric current to the attraction coil 44 is stopped and no magnetic force is not generated, the reaction force of a return spring 46 urging the rotation restriction member 8 pulls the plunger 45 downward in FIG. 1 through the cord-shaped member 7 connecting the rotation restriction member 8 and the plunger 45, thus returning the plunger 45 to the original stationary position (position shown in FIG. 1).

The motor contact comprises a battery side fixed contact 47, a motor side fixed contact (not shown) positioned inside the rear case 25, and a movable contact 48. The battery side fixed contact 47 is integral with a battery terminal 49 connected with the battery through a cable and confronts the movable contact 48 inside the rear case 25. A screw on which a nut (not shown) is tightened is formed on the peripheral surface of the battery terminal 49. A washer 50 is tightened on the screw projecting from the rear case 25 to fix the battery terminal 49 to the rear case 25.

The motor side fixed contact is electrically connected with the positive polarity brush 13A through the battery terminal 49 and arranged alongside the battery side fixed contact 47, thus confronting the movable contact 48.

The movable contact 48 is installed on the upper end of the rod 51 connected with the plunger 45 through an insulation member 52 and urged by a contact spring 53 through the insulation member 52. As a result of the upward movement of the plunger 45, the movable contact 48 moves upward, thus electrically contacting both fixed contacts (hereinafter represented by the battery side fixed contact 47). As a result, the motor contact is turned on. When the movable contact 48 moves away (downward) from both fixed contacts 47, the motor contact is turned off.

A metal rod is looped and both ends 8*a* and 8*b* thereof are bent approximately perpendicularly in the same direction to form the rotation restriction member 8. The looped part of the rotation restriction member 8 is positioned in a flat space formed between the front end surface of the center case 20 and a plate 54 fixed to the center case 20 so that the entire rotation restriction member 8 is vertically movable in FIG. 1 with respect to the plate 54 and the center case 20 and constantly urged upward in FIG. 1 by a return spring 46 fixed to the plate 54.

Both ends 8*a* and 8*b* of the rotation restriction member 8 bent perpendicularly are taken out forward from the plate 54 through open portions formed on the plate 54. One end 8*a* of the rotation restriction member 8 is positioned radially upward from the output shaft 4 and radially outward from the periphery of the collar 38 of the pinion-moving member 5, whereas the other end 8*b* thereof is positioned radially downward from the output shaft 4 and rearward from the pinion-moving member 5. The length of one end 8*a* of the rotation restriction member 8 is so set that one end 8*a* is capable of engaging the tooth 38*a* formed on the collar 38 of the pinion-moving member 5 when the rotation restriction member 8 has moved downward in a state in which the pinion-moving member 5 has moved forward a predetermined amount (for example, state in which the end surface of the pinion gear 37 is at the position at which it contacts an end surface of the ring gear 41).

When the attraction force (plunger-attracting force) of the electromagnetic switch 6 is transmitted to the rotation restriction member 8 through the cord-shaped member 7, the rotation restriction member 8 moves downward in FIG. 1 against the urging force of the return spring 46, whereas when the magnetic circuit of the electromagnetic switch 6 is turned off, the rotation restriction member 8 is returned to the original stationary position (position shown in FIG. 1) by the urging force of the return spring 46.

Supposing that the distance between one end 8*a* of the rotation restriction member 8 and the peripheral surface of the collar 38 of the pinion-moving member 5 is L1 and the distance between the movable contact 48 of the electromagnetic switch 6 and both fixed contacts 47 is L2, the relationship between L1 and L2 is set as $L1 \leqq L2$, when the starter 1 is not in operation.

The above starter operates as follows.

When a key switch (not shown) is turned on, electric current flows from the battery to the attraction coil 44 of the electromagnetic switch 6 to generate a magnetic force which is applied to the plunger 45. Consequently, the plunger 45 is moved upward in FIG. 1, with the result that the other end 8b of the rotation restriction member 8 is pulled downward through the cord-shaped member 7, thus moving the entire rotation restriction member 8 downward, with the return spring 46 deflected. Consequently, one end 8a of the rotation restriction member 8 engages the one of the teeth 38a formed on the collar 38 of the pinion-moving member 5, thus preventing the rotation of the pinion-moving member 5.

As a result of the movement of the plunger 45, the movable contact 48 makes contact with both fixed contacts 47, thus turning on the motor contact. As a result, electric current flows through the armature coil 18 and the armature 10 starts to rotate. At this time, the rotation of the pinion-moving member 5 is kept restricted.

The rotation speed of the armature 10 reduced by the reduction gear 3 is transmitted to the output shaft 4. As a result, the output shaft 4 rotates. At this time, because the rotation of the pinion-moving member 5 is restricted as described above, the rotation of the output shaft 4 acts as a force for pressing the pinion-moving member 5 axially through the helical spline 4b thereof. Thus, the pinion-moving member 5 moves forward along the output shaft 4, and the pinion gear 37 engages the ring gear 41. As a result, one end 8a of the rotation restriction member 8 disengages from the tooth 38a of the collar 38, thus allowing the pinion-moving member 5 to rotate. Consequently, the rotation of the armature 10 is transmitted to the ring gear 41 through the pinion gear 37. As a result, the engine starts. One end 8a of the rotation restriction member 8 which has disengaged from the tooth 38a of the collar 38 is positioned in the rear portion of the washer 40, thus preventing the pinion-moving member 5 from moving rearward.

When the key switch is turned off after the engine starts, the supply of electric current to the attraction coil 44 is stopped. As a result, no magnetic force acts on the plunger 45. Thus, the rotation restriction member 8 is moved upward in FIG. 1 and returned to the original stationary position by the reaction force of the return spring 46. Consequently, one end 8a of the rotation restriction member 8 disengages from the rear portion of the washer 40 of the pinion-moving member 5, thus allowing the pinion-moving member 5 to move rearward. As a result, subjected to the reaction force of the spring 36 and the rearward moving force exerted by the helical spline 4b of the output shaft 4, the pinion-moving member 5 is moved rearward along the output shaft 4 and returned to the original stationary position.

When the rotation restriction member 8 moves upward in FIG. 1 by the urging force of the return spring 46, the plunger 45 is pulled downward through the cord-shaped member 7. As a result, the movable contact 48 moves away from both fixed contacts 47, thus turning off the motor contact. Thus, the supply of electric current to the armature coil 18 and hence the rotation of the armature 10 stops.

Figure 2:
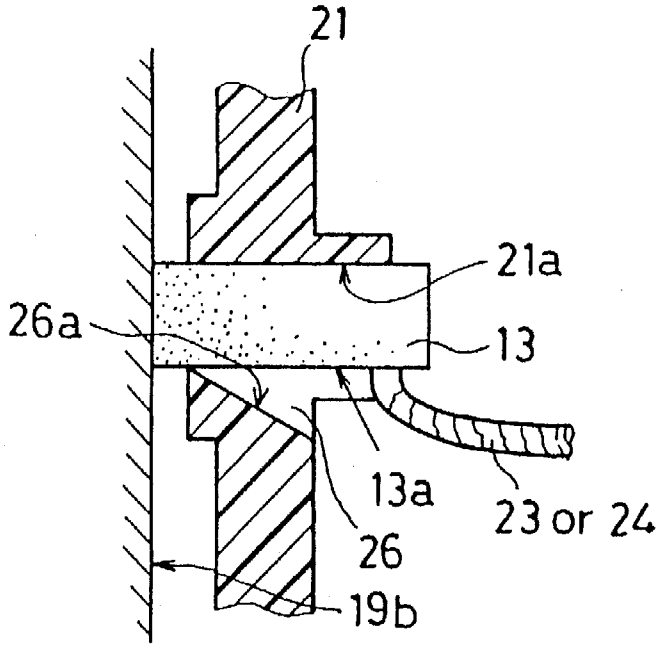
FIG. 2 is an enlarged sectional view showing a brush holder and the shape of a heat release groove in the first embodiment.

In the above embodiment, as shown in FIG. 2, the heat release groove 26 is positioned at the side, of the partitioning portion 21b, confronting the pig tail-fixed side surface 13a of the brush 13 and open toward the space S2 accommodating the electromagnetic switch 6. A wall surface 26a of the heat release groove 26 confronting the side surface 13a of the brush 13 is inclined such that the distance between the side surface 13a and the wall surface 26a becomes gradually greater rearward (right-hand side in FIG. 1) from the commutator surface 19b in the thickness (height) direction of the brush holder 21.

Figure 3:
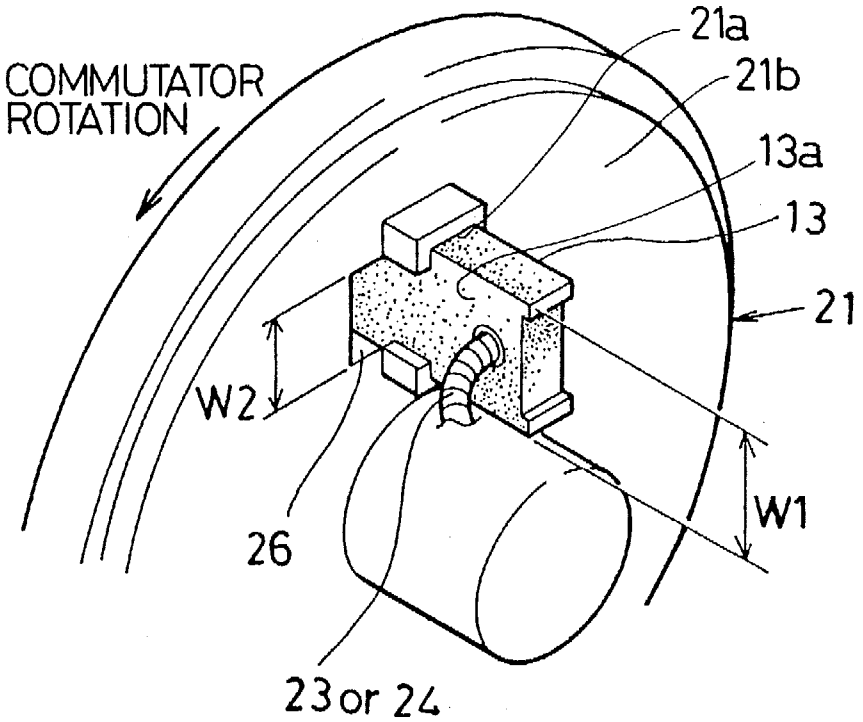
FIG. 3 is a perspective view showing a size relationship between the heat release groove and a brush in a modification of the first embodiment.

It is also possible to provide, as shown in FIG. 3, the pig tail-fixed side surface 13a and the heat release groove 26 are at the slidable-contact termination side of the brush in the rotational direction of the commutator 19. It is preferable that the width W1 of the pig tail-fixed side surface 13a of the brush 13 in the circumferential direction (FIGS. 1 and 2) or radial direction (FIG. 3) and the width W2 of the heat release groove 26 in the circumferential direction (FIGS. 1 and 2) or radial direction (FIG. 3) have the following relationship to prevent the brush 13 from moving from the brush-accommodating hole 21a toward the heat release groove 26: $W2<W1$.

Thus, in the first embodiment, the heat release groove 26 is formed on the surface, of the brush holder 21, on which the brush-accommodating hole 21a is formed, the heat of the brush 13 can be released from the heat release groove 26 to the space S2 accommodating the electromagnetic switch 6. This construction prevents the temperature rise of the brush 13 and reduces the resistance generated on the contact made between the brush 13 and the commutator surface 19b, thus prolonging the longevity of the brush 13.

Figure 5:
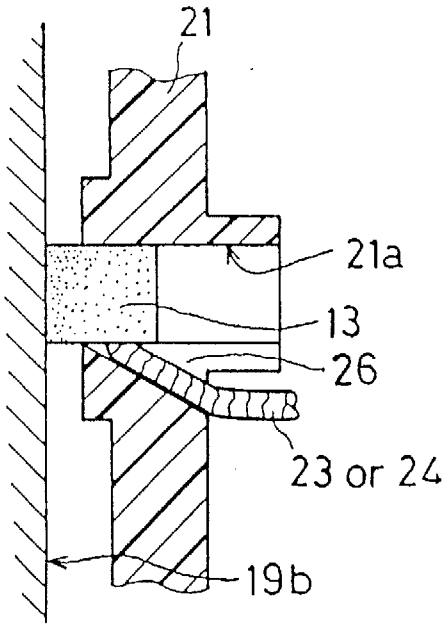
FIG. 5 is a sectional view showing operation of the heat release groove when the brush is worn in the first embodiment.
Figure 4:
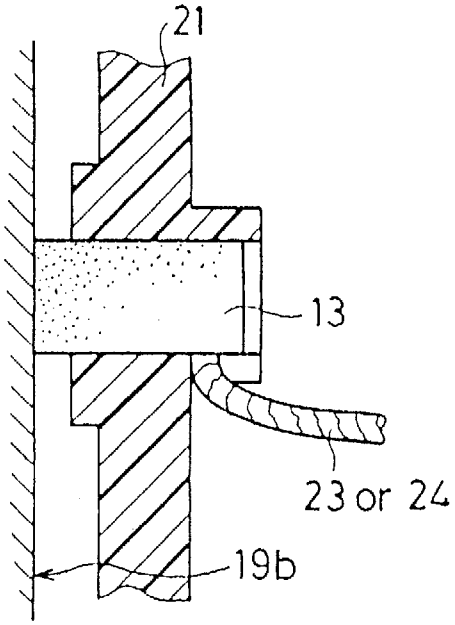
FIG. 4 PRIOR ART
FIG. 4 is a sectional view showing a brush holder having no heat release groove.

Further, as the whole length of the brush 13 becomes short due to the slidable contact-caused abrasion, the brush 13 has its wear limit when the end of the pig tails 23 and 24 contact an end surface of the brush holder 21, as shown in FIG. 4. On the other hand, in the first embodiment, the pig tails 23 and 24 are allowed to enter the heat release groove 26. Thus, even when the entire length of the brush 13 becomes short, the brush 13 can be used effectively because the pig tails 23 and 24 can enter thereinto as shown in FIG. 5. Accordingly, the provision of the heat release groove 26 allows the brush 13 shorter than the one (FIG. 4) to be used for a period of time equal to that in which the one (FIG. 4) is used.

Because the wall surface 26a of the heat release groove 26 is inclined, the pig tails 23 and 24 can be held on the inclined surface of the heat release groove 26 without applying a great stress to the pig tails 23 and 24 even when the ends thereof enter deep (the side at which side commutator surface 19b is located) thereinto.

This embodiment is more effective in a case in which the brush holder 21 is made of resin and hence and has a low degree of thermal conductivity than in a case in which the brush holder 21 is made of a material, for example, iron or ceramic having a 5 high degree of thermal conductivity, because the heat of the brush 13 can be efficiently released from the heat release groove 26 and hence the brush 13 has a long longevity. Therefore, the brush holder 21 made of iron can be used in the first embodiment.

(Second Embodiment)

Figure 6:
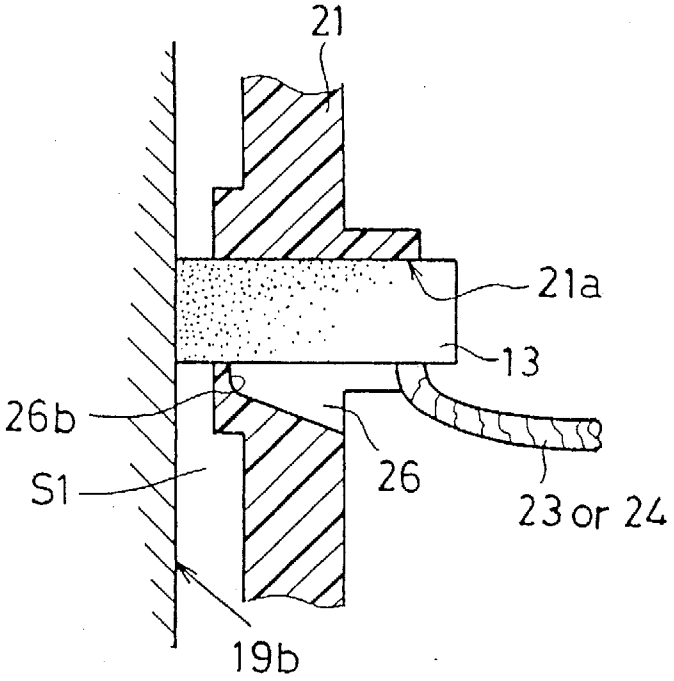
FIG. 6 is a sectional view showing a brush holder and a heat release groove according to a second embodiment of the present invention.

In the second embodiment shown in FIG. 6, the heat release groove 26 has the bottom 26b at the side at which side commutator surface 19b is located. Because in this construction, the heat release groove 26 does not communicate with the space S1 accommodating the armature 10, the heat release performance of the brush holder 21 of the second embodiment is a little inferior to that of the first embodiment.

As in the case of the first embodiment, the heat release groove 26 can be utilized as the groove into which the pig tails 23 and 24 move. That is, the brush 13 can be effectively used. Thus, the brush 13 is shorter than the conventional one.

(Third Embodiment)

Figure 7:
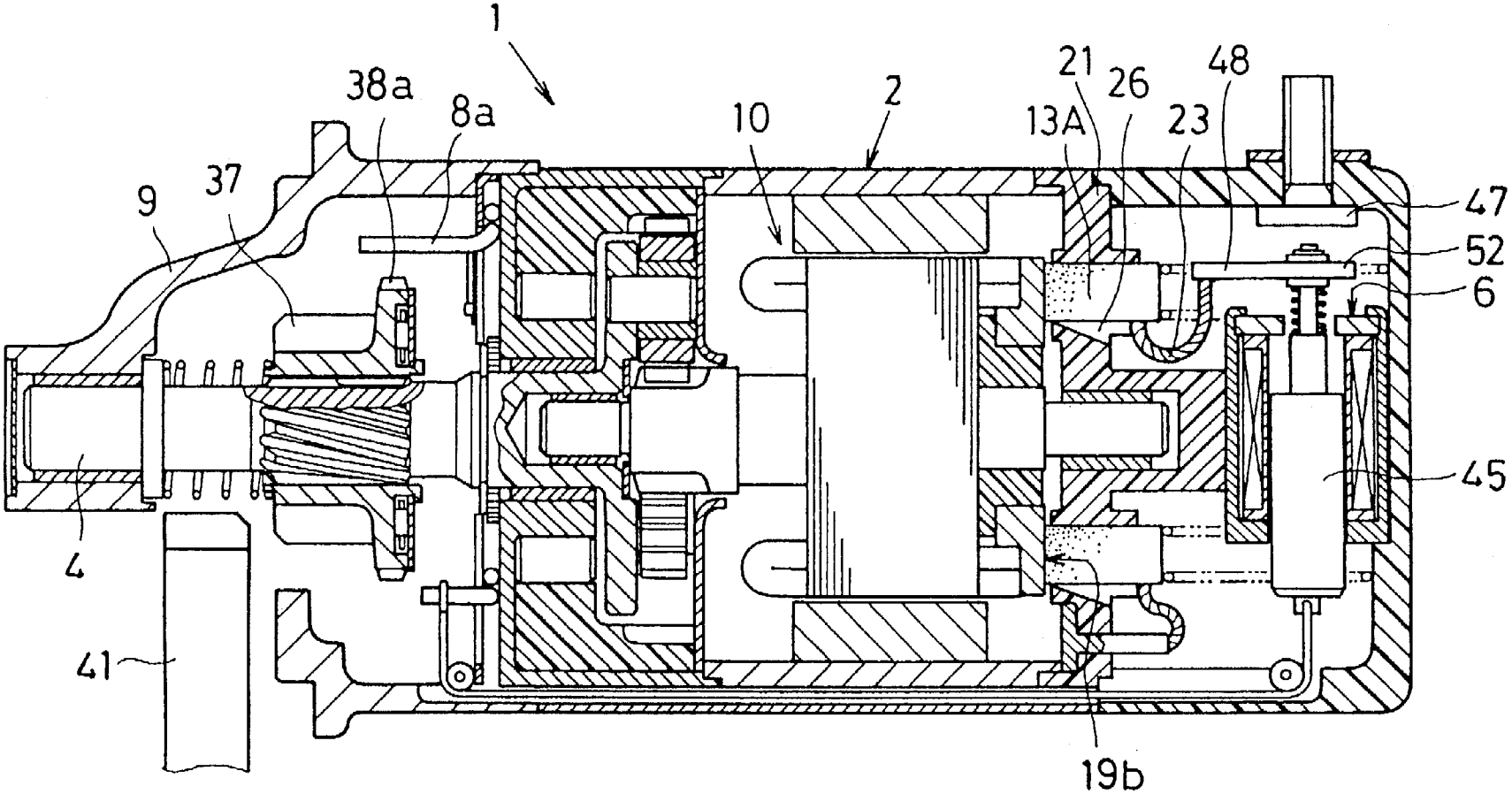
FIG. 7 is a sectional view showing a starter according to a third embodiment of the present invention.

In the third embodiment shown in FIG. 7, the pig tail 23 of the positive polarity brush 13A is electrically and mechanically connected with the movable contact 48 of the electromagnetic switch 6.

When the plunger 45 of the electromagnetic switch 6 is moved by the vibration of the engine, the brush 13 is vibrated greatly in slidable contact with the commutator surface 19*b* and in addition, heat generated at the portion of contact between the movable contact 48 and both fixed contacts 47 is transmitted to the positive polarity brush 13A through the pig tail 23. Consequently, the longevity of the positive polarity brush 13A may be greatly reduced. However, the heat release groove 26 releases the heat of the positive polarity brush 13A, thus prolonging the longevity of the positive polarity brush 13A.

In the above embodiments, the heat release groove 26 is provided at the radially inside part of the brush accomodating hole 21*a*. However, it is preferable that as shown in FIG. 3, the heat release groove 26 is formed on the surface, of the brush holder 21, on which the brush-accommodating hole 21*a* is formed such that the heat release groove 26 is located at the slidable-contact termination side of the brush 13 in the rotational direction of the commutator 19. This construction prevents powders of the brush 13 generated by the slidable-contact between the brush 13 and the commutator surface 19*b* from striking the slidable-contact starting side of the brush 13 and penetrating into the space S2 accommodating the electromagnetic switch 6, with the rotation of the commutator 19.

The present invention should not be limited to the above-disclosed embodiments but may be modified and altered further more without departing from the spirit of the invention.

I claim:

1. A starter comprising:

a starting motor having an armature, a rotation shaft, a commutator, a brush slidably contacting the commutator and a brush holder holding the brush, the commutator having a slidable contact surface substantially perpendicular to the rotation shaft; and an electromagnetic switch positioned axially adjacent to the armature for controlling supply of electric current to the starting motor.

wherein the brush holder has a partitioning portion substantially partitioning a space accommodating the commutator and a space accommodating the electromagnetic switch from each other, a brush-accommodating hole for axially movably accommodating the brush, and a concavity provided on a peripheral wall surface, of the brush holder, on which the brush-accommodating hole is provided and communicating with the space accommodating the electromagnetic switch, wherein the concavity is provided such that the concavity is located solely at a slidable-contact termination side of the brush in a rotational direction of the commutator.

2. The starter according to claim 1, wherein the concavity is defined by an inclined surface in the partitioning portion so that the concavity becomes larger at the side opposite to the commutator.

3. The starter according to claim 1, wherein the concavity is formed at a side of the peripheral surface confronting a pig tail-fixed side surface of the brush thereby to allow a pig tail to enter into the concavity when an entire length of the brush becomes short due to wear.

4. The starter according to claim 1, wherein a width W1 of the brush side surface confronting the concavity is larger than a width W2 of the concavity.

5. The starter according to claim 1, wherein a pig tail is connected with the brush and is electrically and mechanically connected with a movable contact of the electromagnetic switch.

6. The starter according to claim 1, wherein the brush holder is made of resin or ceramics.

7. The starter according to claim 2, wherein the concavity is formed at a side of the peripheral surface confronting a pig tail-fixed side surface of the brush thereby to allow a pig tail to enter into the concavity when an entire length of the brush becomes short due to wear.

8. The starter according to claim 2, wherein a width W1 of the brush side surface confronting the concavity is larger than a width W2 of the concavity.

9. The starter according to claim 2, wherein a pig tail is connected with the brush and is electrically and mechanically connected with a movable contact of the electromagnetic switch.

10. A starter comprising:

a housing;

a rotation shaft supported in the housing;

an armature rotatable with the shaft;

a commutator disposed adjacent to the armature and having a slidable contact surface, a brush slidable on the slidable contact surface of the commutator and having a pig tail for electric power supply: and a brush holder held in the housing and movably holding the brush therethrough, the brush holder having a partitioning portion substantially partitioning a space at a side of the commutator and a space at a side of the pig tail, the brush holder having a brush-accommodating hole for movably accommodating the brush therein and a concavity provided continuously with the brush accommodating hole, the concavity having a size which restricts the brush from moving from the brush-accommodating hole thereinto and wherein the concavity is provided solely at a slidable-contact termination side of the brush in a rotational direction of the commutator.

11. The starter according to claim 10, wherein the concavity is provided such that concavity is located at a side of the brush to which the pig tail is connected.

12. The starter according to claim 11, wherein the concavity is defined by an inclined surface in the partitioning portion so that the concavity becomes larger at the side opposite to the commutator thereby enabling the pig tail to move into the concavity as the brush wears.

13. The starter according to claim 12, wherein the brush holder is made of resin.

14. The starter according to claim 11, wherein the commutator has the slidable contact surface provided at an axial side of the armature and extending perpendicularly against the rotation shaft.

15. The starter according to claim 14, further comprising:

an electromagnetic switch, disposed adjacent to the brush holder at a side axially opposite to the armature, for controlling electric power supply to the armature.

16. A starter comprising:

a starting motor having an armature, a rotation shaft, a commutator, a plurality of brushes slidably contacting the commutator and a brush holder holding the brushes, the commutator having a slidable contact surface substantially perpendicular to the rotation shaft; and an electromagnetic switch positioned axially adjacent to the armature for controlling supply of electric current to the starting motor, wherein the brush holder has a partitioning portion substantially partitioning a space accommodating the commutator and a space accommodating the electromagnetic switch from each other, a plurality of brush-accommodating holes for axially movably accommodating the brushes, and a plurality of concavities, each provided on a peripheral wall surface, of the brush holder, on which a respective brush-accommodating hole is provided and communicating with the space accommodating the electromagnetic switch, wherein each said concavity is provided solely at a slidable-contact termination side of the corresponding brush and at a pig tail-fixed side surface thereof.

* * * * *